US006525633B1

(12) United States Patent
Leupold

(10) Patent No.: US 6,525,633 B1
(45) Date of Patent: Feb. 25, 2003

(54) RADIAL PERIODIC MAGNETIZATION OF A ROTOR

(75) Inventor: Herbert A. Leupold, Eatontown, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/716,833

(22) Filed: Nov. 16, 2000

(51) Int. Cl.[7] ..... H01F 7/20
(52) U.S. Cl. ..... 335/284; 225/3; 264/108
(58) Field of Search ..... 335/284, 285; 425/3, 24; 264/108, 22, 24

(56) References Cited

U.S. PATENT DOCUMENTS 4,911,627 A * 3/1990 Leupold ..... 425/3
5,861,789 A * 1/1999 Bundy et al. ..... 335/285

* cited by examiner

*Primary Examiner*—Lincoln Donovan
(74) *Attorney, Agent, or Firm*—Michael Zelenka; George B. Tereschuk

(57) ABSTRACT

A method and apparatus for fabricating toroidal rings having a magnetization that alternates or changes direction along its azimuthal axis. Such a toroidal ring is made by first placing an unmagnetized toroidal ring into a first magnetization fixture. The first magnetization fixture is operable to magnetize only given regions of the toroidal ring, where the magnetization in those regions is in the same radial direction along its azimuthal axis. The toroidal ring is then placed in a second magnetization fixture that is operable to magnetize only the regions of the toroidal ring the were substantially unmagnetized by the first magnetization fixture. The direction of magnetization by the second fixture is opposite that of the first fixture. The result is a toroidal ring having a magnetization that alternates direction along its azimuthal axis.

18 Claims, 5 Drawing Sheets

RADIAL PERIODIC MAGNETIZATION OF A ROTOR

GOVERNMENT INTEREST

The invention described herein may be manufactured, used, and licensed by or for the Government for governmental purposes without the payment to us of any royalty thereon.

FIELD OF THE INVENTION

The present invention relates to the field of permanent magnet structures and, more particularly, to apparatus and method for making permanent magnet toroid rings.

BACKGROUND OF THE INVENTION

Permanent magnet structures that produce a working magnetic field are well known in the art. The term "working magnetic field" as used herein refers to a magnetic field that is used to do some type of work. A magnetic field used to magnetize unmagnetized material (e.g. permanent magnet material) is an example of such a working magnetic field.

Some permanent magnet structures are composed of pieces of permanent magnet material arranged to form a shell having an interior cavity wherein the working field is generated. Each piece of permanent magnet material has a magnetization that adds to the overall magnetization of the shell. Depending on the overall magnetization of its shell, a permanent magnet structure can be designed to generate a working field having a given magnitude and a given direction within its cavity.

As stated above, such working fields have been used to magnetize unmagnetized permanent magnet material. Basically, the unmagnetized material is placed in the cavity in which the working field is generated. The working field, depending on its strength and direction, thereby magnetizes the unmagnetized material.

One type of permanent magnet structure used to magnetize permanent magnet material is disclosed in U.S. Pat. No. 4,911,627, entitled "Apparatus For Fabrication Of Permanent Magnet Toroidal Rings", issued to the present inventor on Mar. 27, 1990, and incorporated herein by reference. As taught therein, a hollow cylindrical flux source, formed into a toroidal shape, can be used to magnetize a solid toroidal ring made of unmagnetized material. The hollow cylindrical flux source is basically a shell of permanent magnet material having a cylindrical cavity in which a working field is generated. To become magnetized, the solid toroidal ring is placed in the hollow cylindrical flux source's cavity such that it is exposed to the working field therein. The working field thereby magnetizes the solid toroidal ring. The magnetization of the solid toroidal ring depends on the direction and strength of the working field. The hollow cylindrical flux source can be thought of as a fixture in which the solid toroidal ring is magnetized.

The problem with the '627 method, however, is that the magnetization fixture (i.e. the hollow cylindrical flux source) can only produce a magnetized toroidal ring having a unidirectional magnetization. That is, the magnetization of the toroidal ring is in the same direction at every point along the ring's azimuthal axis. This is due to the fact that the hollow cylindrical flux source, or fixture, taught in '627 has a working field that is unidirectional along its azimuthal axis. Such a unidirectionally magnetized solid toroidal ring may not be desirable for all applications.

SUMMARY OF THE INVENTION

The present invention is a method and apparatus for fabricating solid toroidal rings such that they have a magnetization that changes or alternates direction along their azimuthal axis.

In accordance with the principles of the present invention, a toroidal ring having such an alternating magnetization can be made by first placing an unmagnetized solid toroidal ring , usually of square of rectangular shape, into a first magnetization fixture. The first magnetization fixture is operable to magnetize only given regions or points of the solid toroidal ring. The result is a first-magnetized ring that has a magnetization with a first direction in only the given regions of the ring. The other regions remain substantially unmagnetized or weakly magnetized. The first-magnetized ring is then placed into a second magnetization fixture. The second magnetization fixture is operable to only magnetize the unmagnetized or weakly magnetized regions of the first magnetized ring such that the unmagnetized regions become magnetized in a direction that is opposite to the first direction. The result, in accordance with the principles of the present invention, is a solid toroidal ring having a magnetization that completely reverses direction at given points along its azimuthal axis.

In particular embodiments, each magnetization fixture is a hollow cylindrical flux source that is equatorially split into two halves. When the two halves are brought together they form a hollow cylindrical cavity of circular cross-section in which a working magnetic field is generated. Each fixture has a notched filler placed in its hollow toroidal cavity. The notched filler is composed of a passive material such as iron. The notched filler works in conjunction with the hollow cylindrical flux source generate a circumferentially or azimuthally periodic radial working field in the cavity of the fixture. The working field is called a circumferentially or azimuthally periodic working field because it-periodically alternates between a "high" and "low" level of field strength along the axis of the shell. The field strength is referred to as "high" between the iron teeth of the notched filler because the working field in that space of the cavity has a strength that can strongly magnetize (e.g. saturate) unmagnetized material placed therein. The field strength is referred to as "low" between the notches of the notched filler because the working field in that space of the cavity has a strength that can, at best, weakly-magnetize unmagnetized material placed therein. The difference between the two fixtures, however, is that notches of the notched filler in one fixture are in the same location as the teeth of the notched filler in the other fixture. As a result, the direction of the circumferentially periodic working field in one shell is opposite to the direction of the circumferentially periodic working field in the other shell. That is, the location having a high field in one fixture will have a low field in the other fixture. Thus, in accordance with the principles of the present invention, successively placing a solid toroidal ring in the two fixtures will result in a magnetized toroidal ring having a magnetization that alternates direction along its azimuthal axis.

These and other features of the invention will become more apparent from the Detailed Description when taken with the drawing(s). The scope of the invention, however, is limited only by the claims.

DETAILED DESCRIPTION

Figure 1:
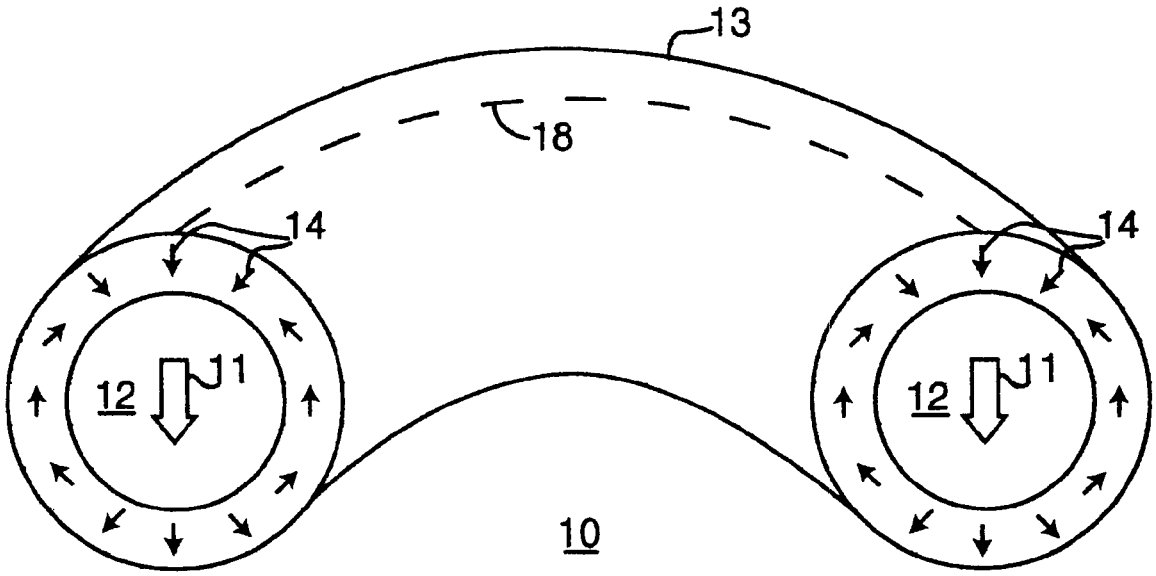
FIG. 1 PRIOR ART
FIG. 1 is a cross-sectional view of a hollow cylindrical flux source that generates a unidirectional radial working field in its cavity.

Referring now to FIG. 1, there is shown a cross-sectional view of a hollow cylindrical flux source 10 that generates a radial working field 11 in its cavity 12. As shown, flux source 10 is composed of a shell 13 of permanent magnet material having a magnetization indicated by arrows 14. The magnetization of shell 13 is such that shell 13 generates a unidirectional radial working field 11 along azimuthal axis 18 in cavity 12. The shell magnetization required to achieve such a unidirectional radial working field 11 is well known in the art.

Figure 2:
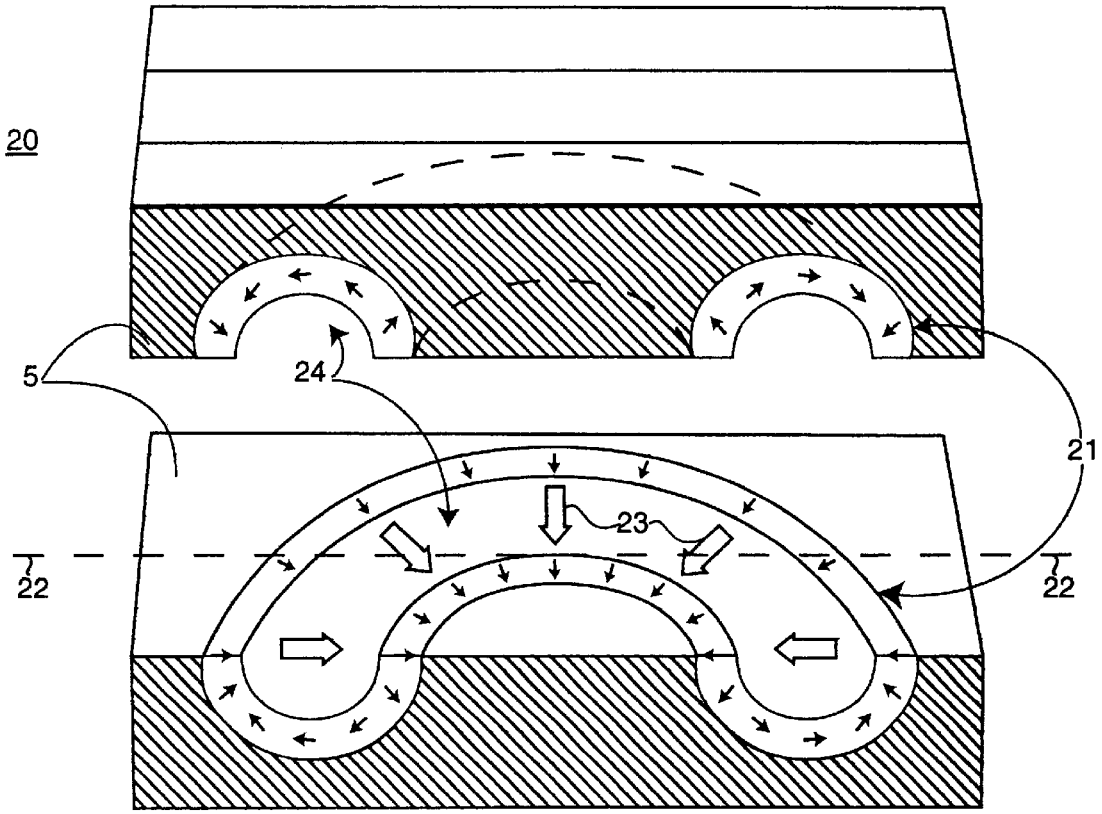
FIG. 2 PRIOR ART
FIG. 2 is a cross-sectional view of a magnetization fixture having a cavity in which an unmagnetized solid toroidal ring can be magnetized.
Figure 3:
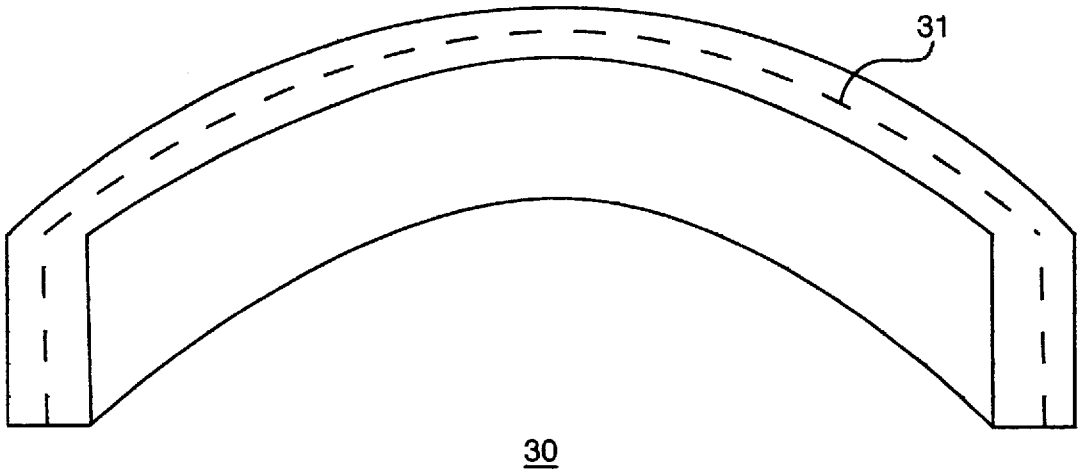
FIG. 3 PRIOR ART
FIG. 3 is a cross-sectional view of an unmagnetized solid toroidal ring having a rectangular cross-section.

The present inventor has taught how a flux source such as flux source 10 can be used as a fixture to magnetize a solid toroidal ring. The teachings are disclosed in U.S. Pat. No. 4,911,627, entitled "Apparatus For Fabrication Of Permanent Magnet Toroidal Rings", issued on Mar. 27, 1990. The teachings can best be described by referring now to FIG. 2 herein. FIG. 2 shows an illustrative embodiment 20 of a magnetization fixture as taught in the '627 patent. As shown, magnetization fixture 20 is composed of a magnetized shell 21 imbedded in substrate 5. Substrate 5 is composed of magnetically neutral material and shell 21 is composed of permanent magnet material. Shell 21 and substrate 5 are cut such that shell 21 is separable along its equatorial axis 22, thereby separating shell 21 into two halves. The two halves of shell 21 are magnetized such that when they are brought together they form a cavity 24 in which they generate a unidirectional radial working field 23. An unmagnetized solid toroidal ring, such as toroidal ring 30 shown in FIG. 3, can be magnetized by placing it in cavity 24 and by bringing together the two halves of shell 21. Such placement will expose toroidal ring 30 to unidirectional radial working field 23 in cavity 24. Working field 23 can then act to magnetize toroidal ring 30. The magnetization of the newly magnetized toroid, however, is in the same direction at every point along the azimuthal axis 31 of toroidal ring 30. That is, magnetization fixture 20 is not capable of fabricating a toroid ring having a magnetization that alternates or changes direction at a given point or given points along its azimuthal axis.

Figure 4A:
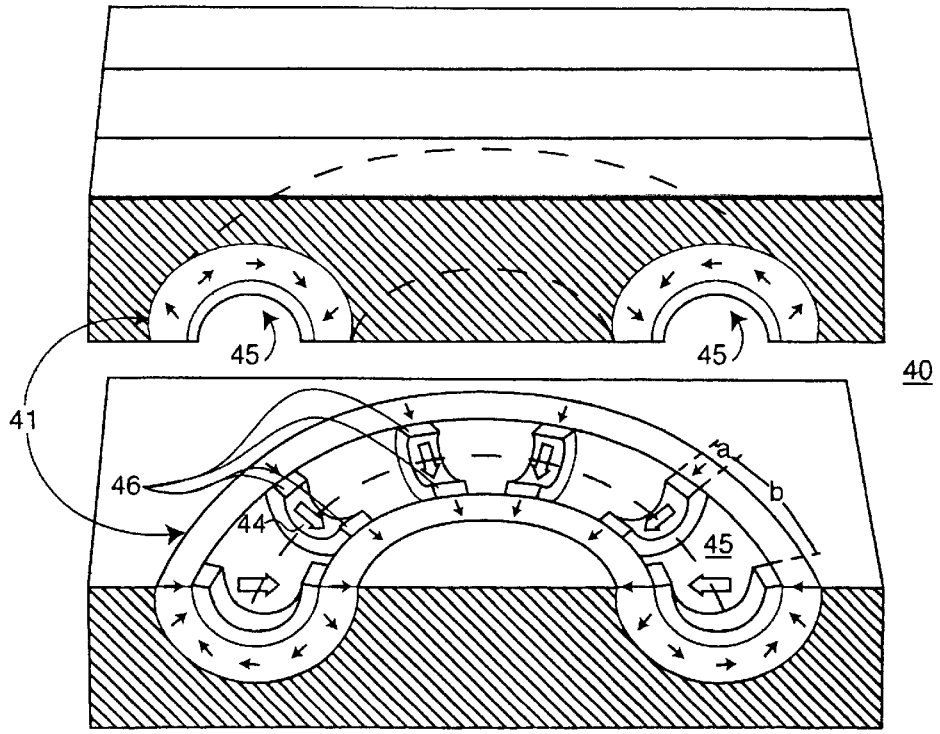
FIG. 4A is a perspective view of a first magnetization fixture in accordance with the principles of the present invention.
Figure 4B:
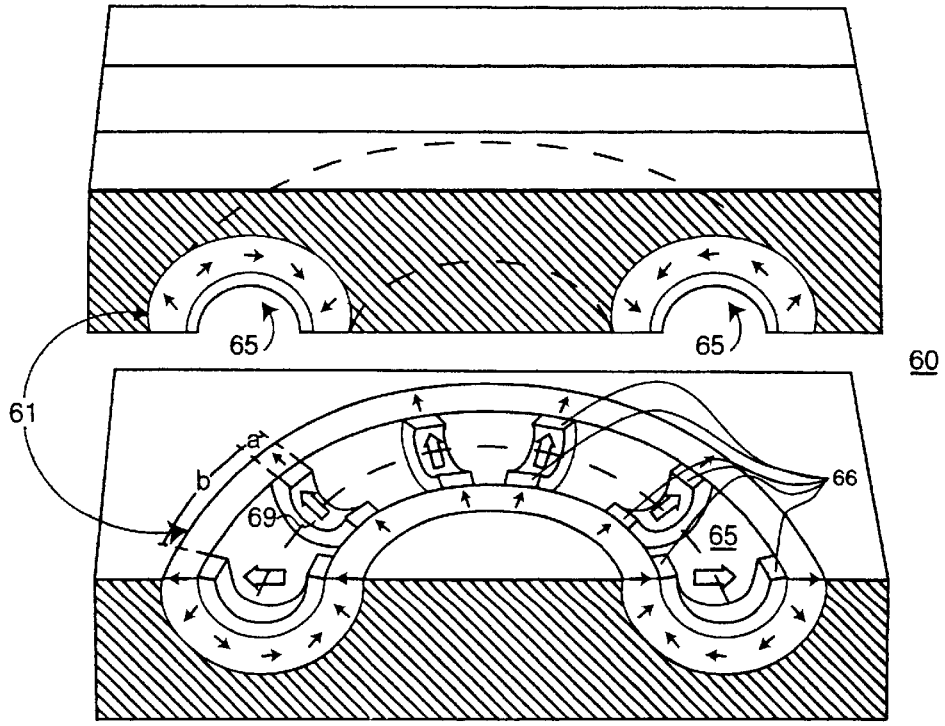
FIG. 4B is a perspective view of a second magnetization fixture in accordance with the principles of the present invention.

The present inventor has solved this problem. In accordance with the principles of the present invention, a toroidal ring having an alternating magnetization can be made by successively placing an unmagnetized toroidal ring in to the cavity of at least two magnetization fixtures. The first magnetization fixture, which is depicted in FIG. 4A, is operable to magnetize only given regions or points of the unmagnetized toroidal ring in a first direction. The other regions remain substantially unmagnetized or weakly magnetized. The second magnetization fixture, which is depicted in FIG. 4B, is operable to only magnetize the unmagnetized or weakly magnetized regions of the toroid ring in a second direction that is opposite to the first direction. Thus, a toroidal ring can be fabricated in accordance with the principles of the present invention by successively placing an unmagnetized toroidal ring in the first and second magnetization fixtures. The placement is such that only regions of the toroidal ring that were unmagnetized or weakly magnetized by the first fixture are magnetized by the second fixture. The result is a magnetized toroidal ring having a magnetization that alternates or changes direction a given points along its azimuthal axis.

Figure 5:
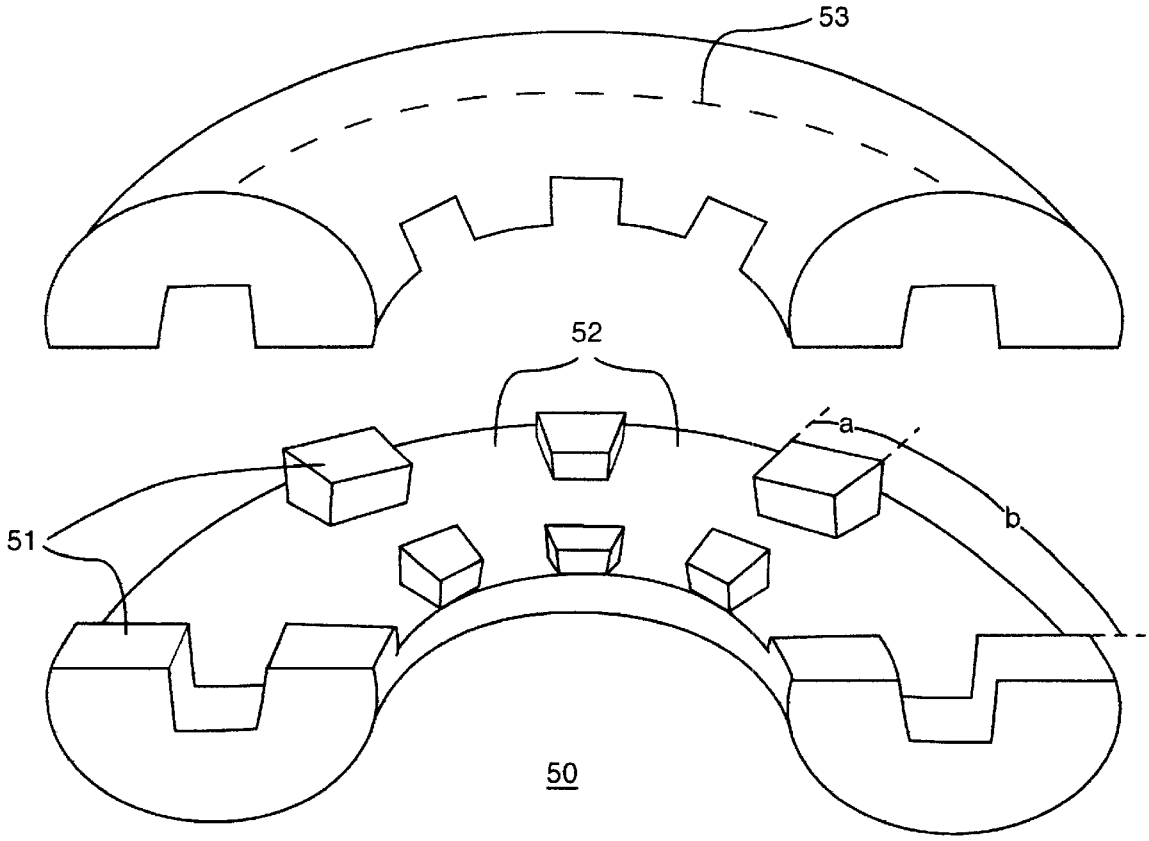
FIG. 5 is a perspective view of a notched filler for use in a magnetization fixture in accordance with the principles of the present invention.

An illustrative embodiment of such a pair of magnetization fixtures 40 and 60, in accordance with the principles of the present invention, are shown in FIG. 4A and FIG. 4B. As shown, first magnetization fixture 40, which is depicted in FIG. 4A, and second magnetization fixture 60, which is depicted FIG. 4B, are composed of shells 41 and 61, respectively. Shells 41 and 61 each form a respective cavity 45 and 65. Shells 41 and 61 are made of permanent magnet material. Adjacent to shells 41 and 61, in respective cavities 45 and 65, are notched fillers 46 and 66, respectively. Notched fillers 46 and 66 are made of iron. An illustrative embodiment 50 of notched fillers 46 and 66 is shown in FIG. 5. As shown, notched filler 50 is composed of teeth 51 and notches 52, which are equally spaced periodically along its azimuthal axis 53. That is, the length "a" of teeth 51 is substantially equal to the length "b" of notches 52.

Referring now back to FIG. 4A and FIG. 4B, respectively, there are shown shells 41 and 61. Shells 41 and 61 are magnetized such that they generate a radial working field having a given direction in their respective cavities 45 and 65. The difference is that the direction of the radial working field in cavity 45 of FIG. 4A is opposite to the direction of the radial working field in cavity 65 in FIG. 4B. Notched fillers 46 and 66 have a shape and location in their respective cavities 45 and 65 such that they impose a circumferentially periodic magnetization on the radial working field generated by their respective shells 41 and 61. The working field is called a circumferentially periodic working field because it periodically alternates between a "high" level and a "low" level of field strength along the respective axis 49 and 69 of its respective cavity 45 and 65. The field strength is "high" when it reaches the level at which it can strongly magnetize (e.g. saturate) an unmagnetized shell placed in its respective cavity 45 and 65. The field strength is "low" when it can, at best, weakly magnetize an unmagnetized shell placed in its respective cavity 45 and 65.

To magnetize a toroidal ring in accordance with the principles of the present invention, an unmagnetized toroidal ring is first placed in cavity 45 of the first magnetization fixture 40, which is depicted in FIG. 4A. This will cause the unmagnetized toroidal ring to be magnetized in those regions of cavity 45 in which the radial working field strength is high. The result is a first-magnetized toroidal shell having strongly and weakly magnetized regions. The first magnetized toroidal shell is then placed in cavity 65 of the second magnetization fixture 60, which is depicted FIG. 4B,. The placement must be such that the strongly magnetized regions are exposed to a "low" working field in cavity 65, whereas the weakly magnetized regions are exposed to the "high" field strength in cavity 65. Since the circumferentially periodic radial working field in cavity 45 is in the opposite direction to the circumferentially periodic radial working field in cavity 65, the two-step magnetization process produces a magnetized toroid having a working field that alternates direction along its azimuthal axis.

While the invention has been particularly shown and described with reference to the first magnetization fixture 40, which is depicted in FIG. 4A, and the second magnetization fixture 60, which is depicted in FIG. 4B, it will be recognized by those skilled in the art that modifications and changes may be made to the present invention without departing from the spirit and scope thereof For example, in particular embodiments, a magnetization structure in accordance with the principles of the present invention may include a notched filler having any number of teeth that generate a high level field and any number of notches that generate a low level field. Also, a magnetization structure in accordance with the principles of the present invention may have a notched filler that is made of permanent magnet material, instead of iron. As a result, the invention in its broader aspects is not limited to specific details shown and described herein. Various modifications may be made without departing from the spirit or scope of the general inventive concept as defined by the appended claims.

Also, it should be noted that the terms and expressions used herein are used as terms of description and not of limitation, and there is no intention, in the use of such terms and expressions, of excluding any equivalents of the features shown and described or any portions thereof.

What is claimed is:

1. A device for magnetizing an unmagnetized toroidal ring, comprising:

a hollow cylindrical flux source having a cavity, said flux source generating a radial working field having a given direction;

a notched filler in said cavity of the hollow cylindrical flux source, said notched filler further comprising a plurality of interlocking teeth and notches equally spaced periodically along an azimuthal axis of said unmagnetized toroid;

said notched filler being operable to impose a circumferentially periodic magnetization on said radial working field generated in the cavity of the hollow cylindrical flux source;

said hollow cylindrical flux source being separable along its equatorial axis such that said unmagnetized toroidal ring can be placed in the hollow cavity of the magnetized toroidal shell;

said circumferentially periodic magnetization of the radial working field in the cavity of the hollow cylindrical flux source includes:

a region in which the working field is strong enough to magnetize part of the magnetized toroidal ring; and a region in which the working field is not strong enough to magnetize the unmagnetized toroidal ring; and causing said unmagnetized toroidal ring to have a magnetization that alternates direction at a plurality of points along said azimuthal axis.

2. A method for forming a magnetized toroidal ring, comprising the steps of:

forming a first magnetizing fixture with a first hollow cavity;

arranging a first plurality of interlocking teeth and notches equally spaced periodically along an azimuthal axis of said unmagnetized toroid to form a first notched filler;

disposing said first notched filler within said first magnetizing fixture;

placing an unmagnetized toroidal ring into said first hollow cavity;

generating a first circumferentially periodic radial working field in said first hollow cavity of the first magnetizing fixture, said first circumferentially periodic radial working field having a given direction in said hollow cavity;

transforming said unmagnetized toroidal ring into a first magnetized toroidal ring having a circumferentially periodic magnetization in a first direction;

forming a second magnetizing fixture with a second hollow cavity;

arranging a second plurality of interlocking teeth and notches equally spaced periodically along said azimuthal axis of the unmagnetized toroid to form a second notched filler;

disposing said second notched filler within said second magnetizing fixture;

placing said first magnetized toroidal ring into said second hollow cavity;

generating a second circumferentially periodic radial working field in said second hollow cavity, said second circumferentially periodic radial working field having a second direction that is opposite to the given direction of the first circumferentially periodic radial working field; and transforming said first magnetized toroidal ring into a fully magnetized toroidal ring having a magnetization that alternates direction at a plurality of points along said azimuthal axis.

3. An apparatus for forming a magnetized toroidal ring, comprising:

forming a first magnetizing fixture with a first hollow cavity;

a first notched filler formed with a first plurality of interlocking teeth and notches equally spaced periodically along an azimuthal axis of said unmagnetized toroid;

said first notched filler being disposed within said first magnetizing fixture;

said first magnetizing fixture generating a first circumferentially periodic radial working field in said first hollow cavity, said first circumferentially periodic radial working field having a given direction in the first hollow cavity;

said first magnetizing fixture thereby being operable to transform an unmagnetized toroidal ring placed into said first hollow cavity into a first magnetized toroidal ring having a circumferentially periodic magnetization in a first direction; and forming a second magnetizing fixture with a second hollow cavity;

a second notched filler formed with a second plurality of interlocking teeth and notches equally spaced periodically along said azimuthal axis of the unmagnetized toroid;

said second notched filler being disposed within said second magnetizing fixture; and said second magnetizing fixture generating a first circumferentially periodic radial working field in its cavity, said second circumferentially periodic radial working field having a second direction that is opposite to the given direction of the first circumferentially periodic radial working field, said second magnetizing fixture thereby being operable to transform said first magnetized toroidal ring into a fully magnetized toroidal ring having a magnetization that alternates direction at a plurality of points along said azimuthal axis.

4. The apparatus for forming a magnetized toroidal ring, as recited in claim 3, wherein the first and second magnetization fixtures are hollow cylindrical flux sources formed into a toroidal shape.

5. The apparatus for forming a magnetized toroidal ring, as recited in claim 4, further comprising said notched filler being composed of iron.

6. The apparatus for forming a magnetized toroidal ring, as recited in claim 5, further comprising said notched filler being composed of a permanent magnet.

7. The device for magnetizing an unmagnetized toroidal ring, as recited in claim 1, further comprising said notched filler being composed of iron.

8. The device for magnetizing an unmagnetized toroidal ring, as recited in claim 7, further comprising the first and second magnetization fixtures each being hollow cylindrical flux sources formed into a toroidal shape.

9. The device for magnetizing an unmagnetized toroidal ring, as recited in claim 1, further comprising said notched filler being a permanent magnet.

10. The device for magnetizing an unmagnetized toroidal ring, as recited in claim 9, further comprising the first and second magnetization fixtures each being hollow cylindrical flux sources formed into a toroidal shape.

11. The method for forming a magnetized toroidal ring, as recited in claim 2, further comprising the step of forming said first notched filler with iron.

12. The method for forming a magnetized toroidal ring, as recited in claim 11, further comprising the step of forming said second notched filler with iron.

13. The method for forming a magnetized toroidal ring, as recited in claim 12, wherein said first and second magnetization fixtures each being hollow cylindrical flux sources.

14. The method for forming a magnetized toroidal ring, as recited in claim 13, further comprising the step of forming said first and second magnetization fixtures into a toroidal shape.

15. The method for forming a magnetized toroidal ring, as recited in claim 2, further comprising the step of forming said first notched filler with a permanent magnet.

16. The method for forming a magnetized toroidal ring, as recited in claim 14, further comprising the step of forming said second notched filler with a permanent magnet.

17. The method for forming a magnetized toroidal ring, as recited in claim 16, further comprising the first and second magnetization fixtures each being hollow cylindrical flux sources.

18. The method for forming a magnetized toroidal ring, as recited in claim 17, further comprising the step of forming said first and second magnetization fixtures into a toroidal shape.

* * * * *